US005598619A

United States Patent [19]

Rosier

[11] Patent Number: 5,598,619

[45] Date of Patent: Feb. 4, 1997

[54] HYDRAULIC INSTALLATION TOOL

[75] Inventor: Hendrik E. Rosier, Kingston, N.Y.

[73] Assignee: Huck International, Inc., Irvine, Calif.

[21] Appl. No.: 239,460

[22] Filed: May 9, 1994

[51] Int. Cl.[6] ..... B21J 15/20

[52] U.S. Cl. ..... 29/243.523

[58] Field of Search ..... 29/243.521, 243.523, 29/243.524

[56] References Cited

U.S. PATENT DOCUMENTS

| | | | |
|---|---|---|---|
| 3,107,806 | 10/1963 | Van Hecke et al. . | |
| 3,329,000 | 7/1967 | Schwab et al. . | |
| 3,362,211 | 1/1968 | Chirco . | |
| 3,446,509 | 5/1969 | Colosimo . | |
| 3,523,441 | 8/1970 | Bell et al. | 29/243.523 |
| 3,534,580 | 10/1970 | Chirco . | |
| 3,605,478 | 9/1971 | Chirco . | |
| 4,324,518 | 4/1982 | Dixon . | |
| 4,347,728 | 9/1982 | Smith . | |
| 4,580,435 | 4/1986 | Port et al. . | |
| 4,609,317 | 9/1986 | Dixon et al. . | |
| 4,627,775 | 12/1986 | Dixon . | |
| 4,770,023 | 9/1988 | Schwab | 29/243.523 |
| 4,796,455 | 1/1989 | Rosier . | |
| 4,813,261 | 3/1989 | Rosier . | |
| 4,844,673 | 7/1989 | Kendall . | |
| 4,852,376 | 8/1989 | Suhov . | |
| 4,863,325 | 9/1989 | Smith . | |
| 4,878,372 | 11/1989 | Port et al. . | |
| 4,964,292 | 10/1990 | Kaelin . | |
| 5,086,551 | 2/1992 | Shamoly et al. | 29/243.523 |
| 5,090,852 | 2/1992 | Dixon . | |
| 5,119,554 | 6/1992 | Wilcox . | |
| 5,146,773 | 9/1992 | Rosier . | |

FOREIGN PATENT DOCUMENTS

| | | | |
|---|---|---|---|
| 2174943 | 11/1986 | United Kingdom | 29/243.523 |

*Primary Examiner*—David Jones

*Attorney, Agent, or Firm*—Harness, Dickey & Pierce, P.L.C.

[57] ABSTRACT

A hand held, hydraulically actuated installation tool installs multi-pieced fasteners having fastener components including a pin and a collar and/or sleeve by applying a relative axial force therebetween by a nose assembly which has a jaw structure for gripping the shank of the pin and an anvil for engaging the collar or sleeve and for severing a pintail portion of the shank after completion of the installation. A power cylinder housing is provided having a cylinder housing section and an integrally formed handle section with hydraulic passageways extending through the handle with internal parting to the cylinder housing. While the nose assembly can be readily installed and removed, the anvil member can be selectively rotated when the nose assembly is installed. A pintail deflector is located at the back end of the installation tool for deflecting the severed pintail portions away from the operator with the deflector having a generally elastomeric body portion with a wear plate adapted to receive the impact of the severed portions of fasteners being installed.

15 Claims, 3 Drawing Sheets

HYDRAULIC INSTALLATION TOOL

SUMMARY BACKGROUND OF THE INVENTION

The present invention relates to installation tools for setting pull type fasteners. A general example of such an installation tool is shown in U.S. Pat. No. 3,329,000 issued Jul. 4, 1967 to Schwab et al for Swaging Tool. See also the U.S. Pat. No. 4,964,292 issued Oct. 23, 1990 to Kaelin et al for "Shock Absorbing Fluid Actuated Pressure System". Such tools include nose assemblies, examples of which are shown in U.S. Pat. No. 3,107,806 issued Oct. 22, 1963 to Van Hecke et al for "Modified Nose Assembly", and U.S. Pat. No. 4,347,728, issued Sep. 7, 1982 to Smith for "Apparatus And System For Setting Fasteners".

As can be seen, these installation tools and related nose assemblies are utilized in conjunction with a hydraulic and/or pneumatic power source for installing multi-pieced fasteners by applying a relative axial pulling force, for example, between a pin or mandrel and a collar or sleeve. Examples of lockbolts or swage type fasteners employing a pin and collar and adapted to be set with a relative axial pulling force are shown in the '728 Smith patent, supra, U.S. Pat. No. 4,324,518, issued Apr. 13, 1992 to Dixon for "Dish Compensating Flush Head Fastener", and U.S. Pat. No. 5,090,852, issued Feb. 25, 1992 to Dixon for "High Strength Fastener And Method". Examples of blind type fasteners employing a pin and a sleeve and adapted to be set by a relative axial pulling force are shown in U.S. Pat. No. 4,627,775 issued Dec. 9, 1986 to Dixon for "Blind Fastener With Grip Compensating Means", U.S. Pat. No. 4,844,673, issued Jul. 4, 1989 to Kendall for "Lock Spindle Blind Bolt With Lock Collar Providing Pin Stop Support" and U.S. Pat. No. 4,863,325, issued Sep. 5, 1989 to Smith for "Two Piece Blind Fastener With Lock Spindle Construction". With both the lockbolt and blind type fasteners, the pin has an elongated shank provided with a pintail or pull portion having a plurality of pull grooves adapted to be gripped by a plurality of chuck jaws in the nose assembly. In the deactuated condition, the chuck jaws will be normally held open to facilitate insertion of the pintail portion into the aperture defined by the opened chuck jaws as well as ejection after the fastener has been set. During actuation with the pintail portion located in the nose assembly, the chuck jaws will be moved to a closed condition for engagement with the pull grooves whereby the pull grooves will be gripped by the chuck jaws.

An anvil member is adapted to engage the collar or sleeve, depending upon the type of fastener, and, upon actuation of the tool and with the chuck jaws gripping the pintail portion of the pin shank, as noted, a relative axial pulling force is then applied between the collar or sleeve and pin of the fastener by way of the relative axial force between the chuck jaws and the anvil. Typically the pin or mandrel is provided with a weakened portion or breakneck groove which is located on the pin shank between the pull or pintail portion and the remainder of the shank and is adapted to fracture at a preselected axial load, i.e. pin break load, after the fastener has been set. This results in an installed fastener having a generally flush and/or compact structure with minimal or no pintail protrusion. In certain tools the severed pintail portion is ejected rearwardly out through the back end of the tool; see for example the patents to Schwab et al, and to Kaelin et al, supra.

The magnitude of the pin break load required to fracture the breakneck groove, however, can result in the generation of a reaction load of significant magnitude. The magnitude of pin break load can be especially high with swage type fasteners since the breakneck groove must be of sufficient strength to withstand the high installation loads required for the anvil to swage the collar onto the pin. As a result, in hand held installation tools employing a construction for pass through or rearward ejection, the severed pintail portion could be ejected with a considerable force in the direction of the operator. As a result it has been a common practice with such tools to utilize a pintail deflector made of an elastomeric material to absorb some of the force of the pintail portion and to deflect the pintail portion away from the operator; see Schwab et al and Kaelin et al patents, supra.

In the present invention, a unique pintail deflector construction is provided which provides the deflecting function while enhancing the life of the deflector; in addition the construction permits selection by the operator of the direction of final ejection.

As noted such installation tools include a nose assembly which is separately, removably secured to a power cylinder. The nose assembly includes an anvil member and a collet assembly slidably supported therein. The collet assembly, which includes the chuck jaws, is adapted to be secured to the rod portion of a power piston. In the present invention a unique, simplified attachment construction is provided for removably securing the collet assembly to the piston rod portion.

In addition, for hand held tools, a handle assembly is provided which frequently is a separate assembly adapted to be removably secured to a piston housing. In such structures the handle assembly includes a handle having fluid passageways for carrying hydraulic fluid from a hydraulic pressure source to and from the cylinder housing for actuation of the power piston. While the use of a separate handle facilitates the formation of the passageways during manufacture, it also requires extra assembly steps and the provision of specially constructed hydraulic seals to seal between the passageways in the handle and those operatively related passageways in the cylinder housing. In the present invention a simplified construction is provided whereby the handle and cylinder housing can be a unitary construction and the need for such extra assembly steps and specially constructed hydraulic seals is obviated.

Thus it is an object of the present invention to provide a unique construction for an installation tool including an improved pintail deflector, nose assembly attachment and overall housing construction.

Other objects, features, and advantages of the present invention will become apparent from the subsequent description and the appended claims, taken in conjunction with the accompanying drawings.

DETAILED DESCRIPTION OF A PREFERRED FORM OF THE INVENTION

Figure 2:
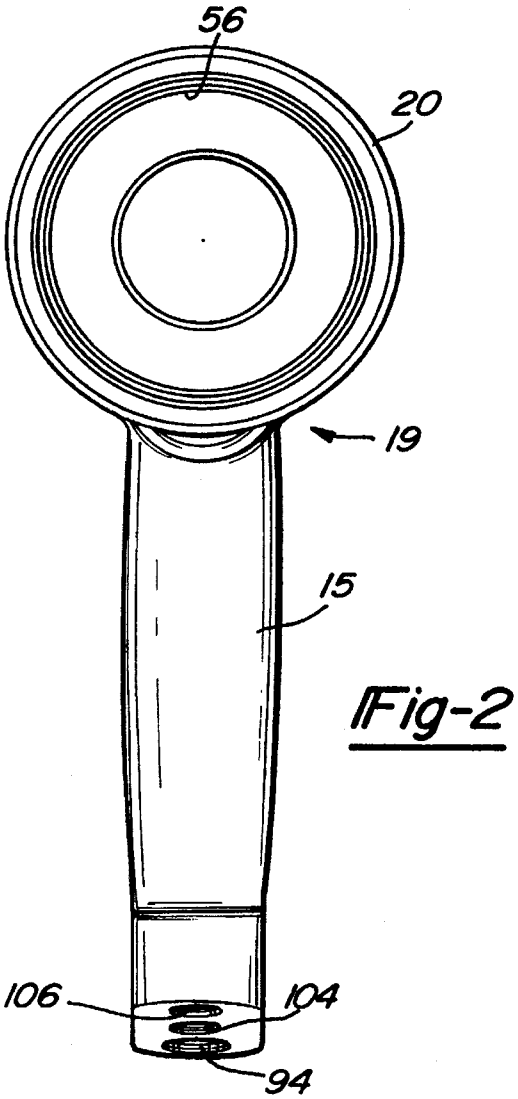
FIG. 2 is an end view, to enlarged scale, of the unitary cylinder housing and handle of FIG. 1 taken generally in the direction of the Arrow A.

Looking now to the drawings, an installation tool is generally indicated by the numeral 10 and includes a nose assembly 12 and a power unit assembly 14. As will be seen the power unit assembly 14 is operable from a source of hydraulic pressure and is adapted to apply a relative axial force through the nose assembly 12 for setting multi-pieced fasteners such as the lockbolt type and/or blind fasteners previously discussed. The power unit assembly 14 includes a power cylinder housing 19 which includes a cylinder housing section 20 with an integrally formed handle section 15 depending therefrom and adapted to be gripped by an operator.

The nose assembly 12 comprises a tubular generally cylindrically shaped anvil housing 16 having an axially extending bore 18 of a stepped construction. The anvil housing 16 is removably secured to the forward end of the cylinder housing section 20 by means of a retaining nut 22, in a manner to be described. The rearward end of the anvil housing 16, which is connected with the retaining nut 22, is open while the opposite or forward end is substantially closed by an anvil portion 24 having a centrally disposed bore or aperture 26 located therein. In the embodiment shown, the bore 26 is configured to define a swage cavity adapted to perform a swaging operation on the collar of a swage type fastener in a manner known in the art; e.g., see the patents previously identified re lockbolt or swage type fasteners and related nose assemblies. It should be noted that while the installation tool 10, as shown and described, is specifically configured for the installation of lockbolt or swage type fasteners, features of the present invention can be utilized for tools for installing blind fasteners and other non-swage type which are installed by the application of a relative axial pulling force.

As noted, the specific embodiment of the installation tool 10 shown in the drawings and described herein is for use in setting swage type fasteners or lockbolts generally of the type shown in the '852 and '518 patents to Dixon, supra. Details of such fasteners have been omitted for purposes of simplicity it being understood that references to pins, collars and portions thereof are of the type well known in the fastener art including those as illustrated in the noted patents.

A collet assembly 28 is located in the anvil housing member 16 and includes a generally tubular collet housing 30 which is slidably supported in bore 18 in the anvil housing member 16. The collet housing 30 has a tubular collar ejector portion 32 at its forward end. The collar ejector portion 32 extends axially and is movable partially within the bore or swage cavity 26 and is adapted to engage the collar of a fastener after it has been swaged by the installation tool 10 and to remove it from the swage cavity 26 at the conclusion of the installation cycle. The collet housing 30 is provided with a through bore 31 which is of a stepped construction and has a frusto-conically shaped seat or tapered bore portion 42 at its forward end for a purpose to be described.

The nose assembly 12 and power unit assembly 14 provide a construction by which the nose assembly 12 can be quickly assembled and disassembled from the power unit assembly 14. Thus the collet housing 30 is provided with an enlarged threaded bore portion 36 at the rearward end of the through bore 31 for threaded assembly onto the threaded, free, outer end 39 of a piston rod portion 38 of a pull piston 40. The free end 39 has a plurality of anti-rotation slots 43 axially extending through its thread form. In one embodiment of the present invention four equally, circumferentially spaced axial slots 43 were employed. A ball lock assembly 41, including a ball and annular sleeve, is located in a locking bore 53 extending radially through the threaded bore portion 36 with the ball adapted to be received within one of the slots 43 in the piston rod free end 39 to lock the collet housing 30 and hence the collet assembly 28 to the piston rod portion 38 from rotation. In assembling the nose assembly 12 to the power unit assembly 14, first the collet assembly 28 is secured to the pull piston 40 by threading the collet housing 30 onto the threaded free end 39 until it engages the shoulder 45 at the inner end of free end 39. Next the collet housing 30 is partially unthreaded until the locking bore 53 is in radial alignment with the first axial slot 43 which it meets. The ball of ball lock assembly 41 is then moved partially out of the locking bore 53 and into the aligned slot 43. Next the anvil housing member 16 is slipped over the collet assembly 28 and into a counterbore in piston rod bore portion 66 at the forward, outer end of the cylinder housing section 20. This now captures the ball, holding it from radial movement out from the engaged slot 43 and in this condition the collet housing 30 and pull piston 40 are locked together from relative rotation.

Next the retaining nut 22 is located over the anvil housing member 16 and is threaded onto the externally threaded outer end of the cylinder housing section 20. The anvil housing member 16 has an annular flange 80 adapted to be located in a stepped bore of the retaining nut 22 whereby the anvil housing member 16 and hence the nose assembly 12 can be removably secured to the outer end of the cylinder housing 20. As assembled the flange 80 is in a slight clearance with the confronting portion of the stepped bore of retaining nut 22 whereby the anvil housing 16 can be rotated after assembly. The forward end of the retaining nut 22 is provided with a plurality of flats 82 to permit gripping by a wrench. Thus when assembled as noted, the collet assembly 28 can be axially reciprocated by the pull piston 40 within the anvil housing member 16. At the same time the nose assembly 12 can be easily, quickly assembled onto the cylinder housing section 20. In addition, as noted, the above construction permits the anvil housing 16 to be freely rotated which could be particularly advantageous to provide selected alignment as with offset nose assemblies such as shown in U.S. Pat. No. 4,796,455 issued Jan. 16, 1989 to Rosier for Compact Offset Nose Assembly For Setting Fasteners and U.S. Pat. No. 4,813,261 issued Mar. 21, 1989 to Rosier for Rotatable Offset Nose Assembly for Setting Fasteners.

The collet assembly 28 includes a chuck jaw assembly 46 which can be of a unitized construction as generally shown and described in the '728 Smith patent, supra.

The unitized jaw assembly 46 comprises a plurality of jaw members 48 secured at their rearward ends to the leading surface of a generally tubular elastomeric sleeve member 50. The radially outer, forward surfaces 49 of the jaw members 48 together define a frusto conically inclined surface which is contoured for matable, sliding engagement with the similarly tapered bore portion 42.

The elastomeric member 50 can be of a flexible urethane construction. The jaw members 48 (which in one form are three in number) are bonded to the sleeve member 50. The rearward ends of the jaw members 48 can be notched, grooved or serrated to increase the surface area and to thereby enhance the bond with the sleeve member 50. The jaw members 48 are thus flexibly secured to the resilient sleeve member 50 and as secured can resiliently move radially. Note that since the sleeve member 50 is elastomeric the jaw members 48 can, to a degree, move resiliently axially forwardly and rearwardly. The jaw assembly 46 includes a support cap 51 which receives and secures the sleeve member 50 at its rearward end. The support cap 51 supports the sleeve member 50 and hence the rearward end of the jaw assembly 46 within the collet bore 18.

The jaw members 48 have teeth 52 for gripping similarly shaped pull grooves located on the pull portion of the pin shank of the shank of a pin member. With the jaw members 48 secured to the sleeve member 50 as described, the teeth 52 of each of the jaw members 48 are located and held in axial alignment with each other.

It is desirable that the jaw members 48 not be held closed under a high preload. To this end, the jaw members 48 can be located via the flexible connection with the sleeve member 50 such that in their relaxed, non actuated condition the jaw members 48 are generally opened, i.e. radially spaced from each other, whereby the crests of the jaw teeth 52 define an insertion diameter which is only slightly less than the crest diameter on the pull or pintail portion of the pin shank whereby a minimum insertion force is required to locate the pull portion of the pin shank within the opening defined by the chuck jaws 48. The initial gripping of the pull grooves of the pin shank will occur when the installation tool 10 is actuated to move the collet housing 30 rearwardly relatively to the anvil housing 16 with the tapered bore portion 42 in engagement with the frusto conical surface 49 of the jaw members 48.

The cylinder housing 20 has a generally uniform cylinder bore 56 which is adapted to receive an enlarged piston head 58 of the pull piston 40. The piston head 58 is adapted to be slidingly supported within the cylinder bore 56 with an annular seal 60 providing hydraulic sealing engagement between the piston head 58 and the confronting wall of the cylinder bore 56. A removable end cap 62 is located at the rearward end of the cylinder housing 20 and cooperates with an annular rear gland 63 to close that end of the cylinder bore 56 with an annular seal 64 providing a radially outer hydraulic seal therewith. The pull piston 40 has a rearwardly extending rod portion 65 which extends through and is slidably supported in aligned openings 67 and 69 of the end cap 62 and rear gland 63, respectively. A wiper seal 73 is supported in opening 69 and acts to keep dirt and contaminants out from a rear, radially inner seal 77.

The cylinder bore 56 is connected at its forward end to a reduced diameter piston rod bore portion 66. A front gland 68 has a front radially inner seal 70, an annular wiper 76 and an annular wiper seal 78 to provide a hydraulic seal with the front piston rod portion 38 while maintaining dirt and contamination out. At the same time, these seals and wipers are adapted to receive and slidably support the front piston rod portion 38. The gland 68 fits snugly within the front cylinder bore 56 and an annular, radially outer seal 72 provides a hydraulic seal therewith. In addition an annular seal 75 seals against a confronting face on the gland 68.

An axially extending valve rod 84 is located in the cylinder bore 56 and extends through the piston head 58 via a bore 86 and defines a relief valve construction generally of the type shown and described in the U.S. Pat. No. 3,362,211 issued Jan. 9, 1968 to Chirco for "Tool Construction". The valve rod 84 has its rearward end axially supported against the inner wall of the end cap 62. The valve rod 84, which is generally circular in cross section, is located snugly, with a generally close tolerance clearance, within the similarly shaped support bore 86. Valve rod 84 terminates at its rearward end adjacent the end cap 62 in a valve portion 88 defined by a plurality of axially extending flats. As noted in the '211 Chirco patent, supra, this provides a means for relieving the high level of hydraulic pressure built up when the pull piston 40 reaches the end of its pull stroke, with the piston head 58 having bottomed out adjacent the end cap 62 and hence with the circular bore 86 then being in line with the flats on the valve portion 88.

The handle section 15 has an electrical actuating switch 90 located and secured therein at its upper portion. Suitable electrical conductors 92 extend through an elongated bore 94 in handle section 15 and are connected to the switch 90 at one end and at the opposite end to a control unit 96 for controlling a hydraulic pressure source 98 to actuate pull piston 40. A pair of hydraulic lines 100 and 102 are connected at one of their ends to fluid passageways 104 and 106, respectively, in handle section 15 and, at their opposite ends, to ports 108 and 110, respectively, of the hydraulic pressure source 98.

The control unit 96 and hydraulic pressure source 98 can be of constructions known in the art, do not constitute a part of the present invention and hence the details thereof have been omitted for purposes of simplicity.

The hydraulic line 100 and passageway 104 are fluid communicated with the rod or pull side of cylinder bore 56 via an enlarged diameter portion 112 of a crossbore 114 and a passageway 116. The hydraulic line 102 and passageway 106 are fluid communicated with the piston head or return side of cylinder bore 56 via a reduced diameter portion 118 of the crossbore 114 and a passageway 120.

Thus hydraulic line 100 is in fluid communication with the rod end of cylinder bore 56 via passageway 106, crossbore portion 112 and passageway 116 while hydraulic line 102 is in fluid communication with the piston head end of cylinder bore 56 via passageway 106, crossbore portion 118 and passageway 120.

The power housing 19 is of a unique construction which facilitates assembly of related components and hydraulic sealing. As can be seen from FIGS. 1 and 2, the power housing 19, including the cylinder housing section 20 and handle section 15, is of a one piece construction which can be made from a casting with internal and external surfaces machined as required. Thus the passageways 104 and 116 can be coaxially machined from the bottom of the handle section 15 to communicate with the cylinder bore 56. The passageway 106 can be similarly machined from the bottom of the handle section 15. In the latter case, however, the passageway 106 is not directly connected to the cylinder bore 56. Thus the crossbore 114 is machined transversely through the handle section 15 and is of a stepped construction including the crossbore portions 112 and 118.

An enlarged bore or cavity 124 is first machined into the face of the handle section 15 to receive the switch 90. This cavity 124 is also conveniently used for the formation of and to permit access to the crossbore 114. The reduced diameter portion 118 is stepped and has a further reduced portion 126 which is extended to terminate near the back end of the cylinder bore 56. This reduced portion 126 is positioned to provide ready access through the rearward end of the cylinder bore 56 to permit machining of the passageway 120 in the direction of Arrow C. The adjoining section between enlarged diameter crossbore portion 112 and reduced diameter crossbore portion 118 is threaded whereby a conventional sealing plug 128 can be received. At the same time the adjoining section between the switch cavity 124 and enlarged diameter crossbore portion 112 is threaded whereby a conventional sealing plug 130 can be received. As can be seen, in this manner the cylinder housing section 20 and handle section 15 can be constructed as the one piece power housing 19. With the handle section 15 integral with the cylinder housing section 20 alignment and relative movement between the two sections is eliminated whereby only simple sealing plugs 128 and 130 are required. This is in contrast to constructions where separate handle and cylinder housing components are used.

With hand held installation tools such as the installation tool 10 it is conventional to provide an outwardly extending lip 141 which acts as a tool support with the handle section 15 extending downwardly therefrom at least around 4 inches to facilitate gripping by the operator.

The pull piston 40 has an axially extending through bore 140 which has a countersunk portion 142 at its forward end and an enlarged splined bore portion 144 at its rearward end. An elongated, cylindrical ejector tube 146 is snugly supported in the through bore 140 and has an enlarged, countersunk type head 148 which is seated in the countersunk bore portion 142 to preclude axial, rearward movement of the ejector tube 146. As can be seen the ejector tube 146 defines a passageway through the pull piston 40 to permit the severed pintail portions to pass rearwardly through the installation tool 10 for ejection from its rearward end. The ejector tube 146 can be made of a relatively hard, wear resistant material such that it will resist wear caused by the repeated ejection of the severed pintail portions. In one form of the invention the ejector tube 146 was constructed of ST 4130 Tubing. The splined bore portion 144 is adapted to receive a similarly shaped tool whereby rotation of the pull piston 40 can be prevented as the collet housing 30 is threaded on or off of the free end 39 of the piston rod portion 38. In this regard, in removal of the nose assembly 12, after the anvil housing member 16 is removed the ball of the ball lock assembly 41 will be simply detented radially outwardly from the associated slot 43 as the collet housing 30 is unthreaded from the threaded piston rod free end 39.

The end cap 62 has a rearwardly extending, reduced diameter retainer portion 150 which is provided with a series of annular retention serrations or barbs 152. An elongated pintail deflector 154 has a deflector body 155 which has an annular retaining portion 156 having a central opening 157 with a plurality of radially inner, annular grooves 159 adapted to engage the retention barbs 152 whereby the pintail deflector 154 can be removably assembled onto the back end of the cylinder housing section 20. The deflector body 155 of pintail deflector 154 is constructed of an elastomeric material such that it can be resiliently, radially expanded for assembly and disassembly relative to the retainer portion 150. In one form of the invention the deflector body 155 was constructed of polyurethane with a 72–78 Durometer.

The deflector body 155 has a shell like section 158 extending axially rearwardly from the annular retaining portion 156 with the section 158 having a generally U-shaped cross section with an elongated opening 160. (See FIG. 4). The rearward end portion 162 of the shell section 158 is in a blocking or deflecting position behind the central opening 157 and hence behind the rearward opening at the end of the installation tool 10 such that the severed pintail portions will engage the rearward end portion 162 as they are ejected. A thin gauge metal deflector or wear plate 164 is secured to the inner surface of the end portion 162 so as to provide a durable, wear resistant surface to receive the impact of the ejected pintail portions. The wear plate 164 can be molded or bonded to the end portion 162.

Figure 5:
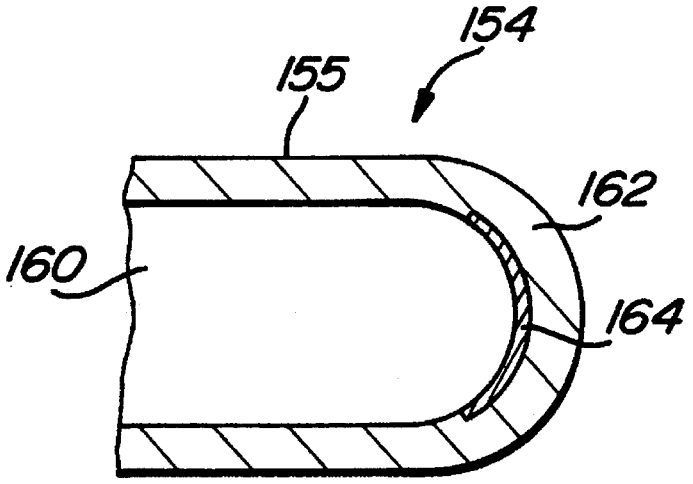
FIG. 5 is a sectional view of the pintail deflector taken generally in the direction of the Arrows 5—5 in FIG. 4..

Looking now to FIG. 5, it can be seen that the wear plate 164 is of an arcuate shape to match the arcuate contour of the inner surface of the end portion 162 to which it is secured. In one form of the invention, the wear plate 164 was constructed from a section of a tube of a selected diameter to provide the desired arcuate shape. In this way a plurality of the wear plates 164 could be constructed from a single length of tubing. In one embodiment the wear plate 164 was constructed of ST 1018 tubing although it is believed that other tubings could be used such as ST 1015 ST 1020 Tubing. With this construction the wear plate can be of a minimal size reducing the cost and in one form was approximately 1 inch in vertical length and approximately 1 inch in circumferential length. Thus the wear plate 164 provides a wear resistant, durable impact surface while at the same time the elastomeric construction of the deflector body 155 absorbs shock loads and minimizes noise from impact of the severed pintail portions.

Note that the engagement of the annular retaining barbs 152 and the grooves 157 permit the pintail deflector 154 to be rotated to thereby locate the opening 160 and the direction of final pintail ejection in essentially any selected direction.

The hydraulic pressure source 98 has a high pressure section for moving the pull piston 40 rearwardly in its setting stroke to set the fastener and an intermediate pressure section for returning the pull piston 40 forwardly to its original position after the fastener has been installed and a low pressure tank or return section which receives the hydraulic fluid displaced from the cylinder bore 56 during the high pressure setting stroke or the intermediate pressure return stroke.

Figure 3:
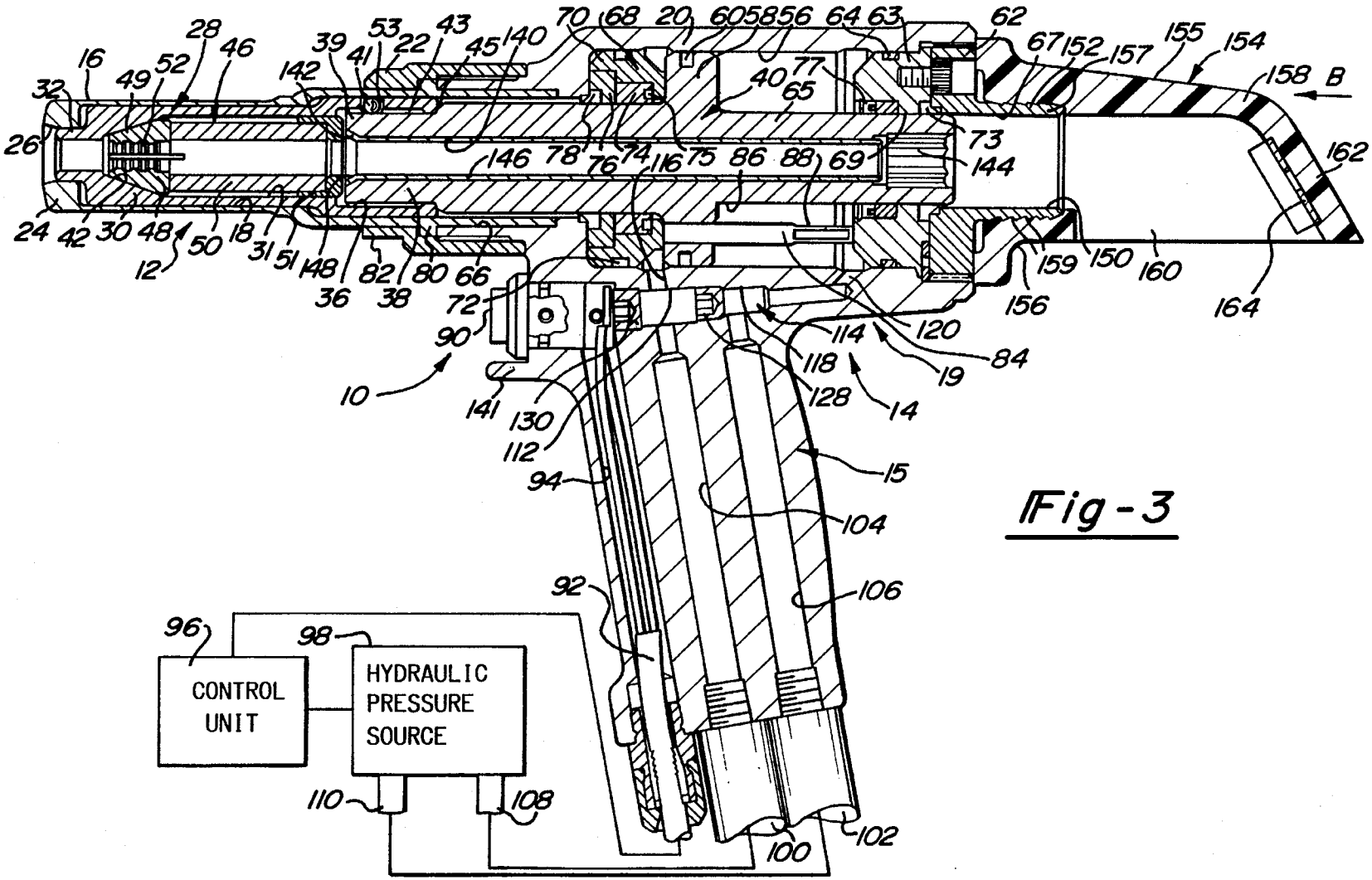
FIG. 3 is a side elevational, sectional view of the fastener installation tool including the unitary cylinder housing and handle construction of FIGS. 1 and 2 with a nose assembly and pintail deflector in assembled relationship and illustrating features of the present invention and with the installation tool shown in the deactuated condition; a control unit and hydraulic pressure source which are operable with the installation tool are generally shown in block form.

The installation tool 10 will be normally in its deactuated condition as shown in FIG. 3. With the actuating switch 90 in its deactuated condition, i.e. when not depressed by the operator, the control unit 96 will condition the hydraulic pressure source 98 to connect the port 108 to the return or tank section and the port 110 to the intermediate pressure section which is at a hydraulic pressure higher than that at the return or tank section. In this condition the rearward end of cylinder bore 56 will be pressurized relative to the front end or forward piston rod side of the cylinder bore 56 urging the pull piston 40 to its returned or deactuated position as shown in FIG. 3. To actuate the installation tool 10, the operator simply depresses the actuating switch 90 which signals the control unit 96 to condition the hydraulic pressure source 98 to connect the port 108, and hence hydraulic line 100, to the high pressure section and to connect the port 110 and hydraulic line 102 to the return or tank section. In this condition, the front end of the cylinder bore 56 will be connected to the high hydraulic pressure section while the rearward end of the cylinder bore 56 will be connected to return or tank section.

Thus in the deactuated condition of installation tool 10, as shown in FIG. 3, the chuck jaws 48 are radially separated and in their opened condition. In this condition, the shank of a pin of a swage type fastener can be inserted through the aperture or swage cavity 26 and into the opening defined by the radially separated chuck jaws 48. Upon actuation of the pull piston 40 rearwardly in its pull stroke, the collet housing 30 is moved rearwardly. As this occurs, the chuck jaws 48 by virtue of the light engagement of the jaw teeth 52 with the pull grooves of the pintail of the fastener are moved radially inwardly by the engagement with the frusto conical bore portion 42. The jaws 48 are moved to their radially closed position in which the jaw teeth 52 now fully grip the similarly shaped grooves on the pull portion of the pin shank of the fastener. With the jaw teeth 52 of jaws 48 gripping the pull grooves of the pin, the adjacent side surfaces of the jaws 48 will be slightly spaced from each other. In this position the chuck jaws 48 will define a generally circular aperture of around 360°. At this time the swage cavity 26 is engaged with the fastener collar which is located over the shank of the pin. Further movement of the collet housing 30 and the jaw assembly 46 relative to the swage cavity 26 will result in application of the desired relative axial force whereby the collar will be swaged onto lock grooves on the shank of the pin. Upon the application of additional relative axial force, the pin member will be severed at the breakneck groove. Upon fracture of the pin shank the resultant shock load will move the jaw assembly 46 axially rearwardly and at the same time will resiliently move the jaws 48 to their open condition whereby the severed portion of the pin shank will be released by the jaws 48. The severed portion of the pin member will then pass through the installation tool 10 via the ejector tube 146 for ejection out at the rearward end. In this regard the sleeve member 50 being resilient does permit deflection of the jaw members 48 and also provides a shock absorbing function at pin break.

Next the installation tool 10 is returned to its original, deactuated condition by the operator releasing the actuating switch 90. In this condition, the control unit 96 conditions the hydraulic pressure source 98 to connect the forward or piston rod end of the cylinder bore 56 to the tank or return section and the piston head end of the cylinder bore 56 to the intermediate pressure section. Now the pull piston 40 on its return stroke is moved axially forwardly to its original, axially forward position. As this occurs, the collar ejector member 32 engaged the swaged collar whereby the swaged collar is ejected from the swage cavity 26.

After pin break and with the pull piston 40 in its fully actuated rearward position at the end of the pull stroke, the high pressure being applied during the pull stroke could increase since the pull piston 40 is no longer moving. The potentially high pressure that could be built up in the forward or piston rod end of cylinder bore 56 is relieved by way of the clearance between the flats of the valve rod 84 and the circular bore 86. In this position the valve portion 88 is, in a sense, actuated to permit high pressure fluid to flow from the forward or rod end of the cylinder bore 56 to the rearward or piston head end and thereafter to the tank or return section of the hydraulic pressure source 98. This reduces the pressure at the forward or rod end of the cylinder bore 56, inhibiting damage to the seals and/or related structure.

Thus a hand held installation tool having a unique feature including unique power cylinder housing having an integral handle section and cylinder housing section and also including a unique pintail deflector construction.

While it will be apparent that the preferred embodiments of the invention disclosed are well calculated to fulfill the objects above stated, it will be appreciated that the invention is susceptible to modification, variation and change without departing from the proper scope or fair meaning of the invention.

What is claimed is:

1. A hand held installation tool for installing multipiece fasteners of the type including a pin and a collar and/or sleeve with the pin having a pull portion and with the fastener adapted to be installed by the application of a predetermined relative axial force between the pin and the collar and/or sleeve, the improvement comprising:

power means including a pull piston having an enlarged piston head adapted for reciprocating axial movement and for providing a relative axial force during such axial movement, installation means including jaw means having opened and closed positions and adapted to grip the pin of the fastener when in said closed position and to release the pin of the fastener when in said opened position, said installation means further including anvil means adapted to engage the collar and/or sleeve of the fastener, said installation means being operatively connected to said piston of said power means for transmitting said relative axial force of said piston between said jaw means and said anvil for applying said predetermined relative axial force between the pin and collar and/or sleeve when said jaw means has gripped the pin of the fastener and said anvil means is in engagement with the collar and/or sleeve of the fastener, said installation means including jaw actuating means operable for moving said jaw means to said opened and closed positions, said power means further including a power cylinder housing having a cylinder housing section and an integrally formed handle section depending from said cylinder housing section and adapted to be gripped by an operator, said cylinder housing section having an axially extending cylinder bore adapted to receive said piston head of said pull piston for reciprocating movement therein, and fluid passage means extending through said handle section, through the juncture integrally connecting said cylinder housing section and said handle section, and radially through said cylinder housing section directly into said cylinder bore for fluid communicating said cylinder bore on opposite sides of said piston head whereby said pull piston can be selectively reciprocated within said power cylinder housing, said fluid passage means comprising a pair of generally parallely extending forward and rear passageways extending upwardly from the bottom of said handle section towards said cylinder housing section, a crossbore extending transversely to said pair of passageways and intersecting both of said pair of passageways near the juncture of said handle section with said cylinder housing section, a forward connecting passage extending substantially directly in line with the forward one of said passageways and into the forward portion of said cylinder bore, a rearward connecting passage extending angularly from the rearward end of said cylinder bore to said crossbore in communication with said rear passageway, seal means in said crossbore for sealing said pair of passageways from each other.

2. The installation tool of claim 1 with said rearward connecting passage located in a position relative to said rearward end of said cylinder bore whereby its axis extends angularly along a line outwardly through said rearward end of said cylinder bore and with a preselected clearance with the rearward end of said cylinder housing section.

3. A hand held installation tool for installing multipiece fasteners of the type including a pin and a collar and/or sleeve with the pin having a pull portion and with the fastener adapted to be installed by the application of a predetermined relative axial force between the pin and the collar and/or sleeve, the improvement comprising:

power means including a pull piston having an enlarged piston head adapted for reciprocating axial movement and for providing a relative axial force during such axial movement, installation means including jaw means having opened and closed positions and adapted to grip the pin of the fastener when in said closed position and to release the pin of the fastener when in said opened position, said installation means further including anvil means adapted to engage the collar and/or sleeve of the fastener, said installation means being operatively connected to said piston of said power means for transmitting said relative axial force of said piston between said jaw means and said anvil for applying said predetermined relative axial force between the pin and collar and/or sleeve when said jaw means has gripped the pin of the fastener and said anvil means is in engagement with the collar and/or sleeve of the fastener, said installation means including jaw actuating means operable for moving said jaw means to said opened and closed positions, said power means further including a power cylinder housing having a cylinder housing section and an integrally formed handle section depending from said cylinder housing section and adapted to be gripped by an operator, said cylinder housing section having an axially extending cylinder bore adapted to receive said piston head of said pull piston for reciprocating movement therein, and fluid passage means extending through said handle section, through the juncture integrally connecting said cylinder housing section and said handle section, and radially through said cylinder housing section directly into said cylinder bore for fluid communicating said cylinder bore on opposite sides of said piston head whereby said pull piston can be selectively reciprocated within said power cylinder housing, said handle section extending downwardly from the juncture of said handle section with said cylinder housing section for a distance of no less than around four inches, said fluid passage means comprising a pair of generally parallely extending forward and rear passageways extending upwardly from the bottom of said handle section towards said cylinder housing section, a crossbore extending transversely to said pair of passageways from said switch bore and intersecting both of said pair of passageways near the juncture of said handle section with said cylinder housing section, a forward connecting passage extending substantially directly in line with the forward one of said passageways and into the forward portion of said cylinder bore, a rearward connecting passage extending angularly from the rearward end of said cylinder bore to said crossbore in communication with said rear passageway, seal means in said crossbore for sealing said pair of passageways from each other and for sealing said crossbore from said switch bore.

4. The installation tool of claim 3 with said rearward connecting passage located in a position relative to said rearward end of said cylinder bore whereby its axis extends angularly along a line outwardly through said rearward end of said cylinder bore and with a preselected clearance with the rearward end of said cylinder housing section.

5. A hand held installation tool for installing multipiece fasteners of the type adapted to be installed by the application of a predetermined relative axial force, the improvement comprising:

power means including a pull piston having an enlarged piston head adapted for reciprocating axial movement and for providing a relative axial force during such axial movement, said power means further including a power cylinder housing having a cylinder housing section and an integrally formed handle section depending from said cylinder housing section and adapted to be gripped by an operator, said cylinder housing section having an axially extending cylinder bore adapted to receive said piston head of said pull piston for reciprocating movement therein, and fluid passage means extending through said handle section through the juncture integrally connecting said cylinder housing section and said handle section and radially through said cylinder housing section directly into said cylinder bore for fluid communicating said cylinder bore on opposite sides of said piston head whereby said pull piston can be selectively reciprocated within said power cylinder housing, said fluid passage means comprising a pair of generally parallely extending forward and rear passageways extending upwardly from the bottom of said handle section towards said cylinder housing section, a crossbore extending transversely to said pair of passageways and intersecting both of said pair of passageways near the juncture of said handle section with said cylinder housing section, a forward connecting passage extending substantially directly in line with the forward one of said passageways and into the forward portion of said cylinder bore, a rearward connecting passage extending angularly from the rearward end of said cylinder bore to said crossbore in communication with said rear passageway, seal means in said crossbore for sealing said pair of passageways from each other.

6. The installation tool of claim 5 with said rearward connecting passage located in a position relative to said rearward end of said cylinder bore whereby its axis extends angularly along a line outwardly through said rearward end of said cylinder bore and with a preselected clearance with the rearward end of said cylinder housing section.

7. A hand held installation tool for installing multipiece fasteners of the type adapted to be installed by the application of a predetermined relative axial force, the improvement comprising:

power means including a pull piston having an enlarged piston head adapted for reciprocating axial movement and for providing a relative axial force during such axial movement, said power means further including a power cylinder housing having a cylinder housing section and an integrally formed handle section depending from said cylinder housing section and adapted to be gripped by an operator, said cylinder housing section having an axially extending cylinder bore adapted to receive said piston head of said pull piston for reciprocating movement therein, and fluid passage means extending through said handle section through the juncture integrally connecting said cylinder housing section and said handle section and radially through said cylinder housing section directly into said cylinder bore for fluid communicating said cylinder bore on opposite sides of said piston head whereby said pull piston can be selectively reciprocated within said power cylinder housing, a manually actuable electrical switch located in an enlarged switch bore in the forward side of said handle section proximate to the juncture of said handle section with said cylinder housing section, said fluid passage means comprising a pair of generally parallely extending forward and rear passageways extending upwardly longitudinally from the bottom of said handle section towards said cylinder housing section, a crossbore extending transversely to said pair of passageways from said switch bore and intersecting both of said pair of passageways near the juncture of said handle section with said cylinder housing section, a forward connecting passage extending substantially directly in line with the forward one of said passageways and into the forward portion of said cylinder bore, a rearward connecting passage extending angularly from the rearward end of said cylinder bore to said crossbore in communication with said rear passageway, seal means in said crossbore for sealing said pair of passageways from each other and for sealing said crossbore from said switch bore.

8. The installation tool of claim 7 with said rearward connecting passage located in a position relative to said rearward end of said cylinder bore whereby its axis extends angularly along a line outwardly through said rearward end of said cylinder bore and with a preselected clearance with the rearward end of said cylinder housing section.

9. In an installation tool for installing multipiece fasteners of the type including a pin and a collar and/or sleeve with the pin having a shank with a pull portion and with the fastener adapted to be installed by the application of a predetermined relative axial force between the pin and the collar and/or sleeve, and with the pin shank having a weakened section adapted to fracture at a preselected magnitude of relative axial force substantially at the completion of the setting action whereby the pull portion is removed, said installation tool including:

power means including a pull piston having an enlarged piston head adapted for reciprocating axial movement and for providing a relative axial force during such axial movement, installation means including jaw means having opened and closed positions, said power means further including a power cylinder housing having a cylinder housing section and a handle section depending from said cylinder housing section, an ejection passage extending axially through said pull piston and adapted to receive the severed pull portion for ejection rearwardly out from said installation tool, the improvement comprising:

a deflector adapted to be secured to the rearward end of said cylinder housing section, and including a deflection portion extending in line with and over said passageway to receive the impact of the severed pull portion, said deflector being constructed of an elastomeric material and having a wear plate at said deflector portion to receive the impact of the severed pull portion, said wear plate being constructed of a hardened, wear resistant material, said deflector including securing means on said deflector and said cylinder housing for securing said deflector to said cylinder housing and permitting selective rotation of said deflector generally around the axis of said ejector passage, said deflector having a discharge opening extending generally between said deflector portion and said securing means for permitting ejection of the severed pull portion and whereby said deflector can be rotated to radially position said discharge opening to eject the severed pull portions in a direction selected by the operator, said deflector being of a one piece body of elastomeric material with said wear plate being a separate metal member secured to said deflection portion, said deflector portion having a generally arcuate shape with said wear plate being constructed from a portion of a tube having a generally similar arcuate shape.

10. An installation tool for installing multipiece fasteners of the type including a pin having a shank and a collar and/or sleeve with the pin having a shank with a pull portion and with the fastener adapted to be installed by the application of a predetermined relative axial force between the pin and the collar and/or sleeve, the improvement comprising:

a power cylinder assembly including a cylinder housing and a piston adapted for reciprocating axial movement in said cylinder housing and for providing a relative axial force during such axial movement, a nose assembly removably secured to said cylinder housing and having an anvil housing having an anvil portion with an opening at one end adapted to receive the shank of the pin, a collet assembly slidably supported in said anvil housing and connected to said piston for reciprocating axial movement therewith, said collet assembly having a collet and jaw means supported in said collet having opened and closed positions and adapted to grip the pull portion of the pin shank when in said closed position and to release the pull portion of the pin shank when in said opened position, said anvil portion adapted to engage the collar and/or sleeve of the fastener, said anvil housing and said collet assembly being operatively connected to said cylinder housing and to said piston for transmitting said relative axial force of said piston between said jaw means and said anvil portion of said anvil housing for applying said predetermined relative axial force between the pin and collar and/or sleeve when said jaw means has gripped the pull portion of the pin shank and said anvil portion is in engagement with the collar and/or sleeve of the fastener, said collet assembly including jaw actuating means operable for moving said jaw means to said opened and closed positions and including resilient spring means operative on said jaw means for providing a spring bias on said jaw means to move said jaw means to said closed position, said piston including a piston rod portion having a threaded outer end, said collet having an enlarged bore at its rearward end adapted to be threadably engaged with said threaded outer end of said piston rod portion whereby said collet assembly will be axially reciprocated by said piston, said threaded outer end of said piston rod portion having a plurality of axially extending slots, said collet having a radially extending locking bore extending through said enlarged bore with a locking ball assembly located therein, said locking ball assembly including a ball member radially movable into a selected one of said slots while remaining at least partially in said locking bore, said anvil housing being located over said collet to capture said ball member in said locking bore and said slot whereby said collet and said piston rod portion are locked together from relative rotation, mounting means removably securing said anvil housing to said cylinder housing.

11. The installation tool of claim 10 with said mounting means securing said anvil housing to said cylinder housing while permitting selective relative rotation therebetween.

12. A hand held installation tool for installing multipiece fasteners of the type including a pin and a collar and/or sleeve with the pin having a pull portion and with the fastener adapted to be installed by the application of a predetermined relative axial force between the pin and the collar and/or sleeve, the improvement comprising:

power means including a pull piston having an enlarged piston head adapted for reciprocating axial movement and for providing a relative axial force during such axial movement, installation means including jaw means having opened and closed positions and adapted to grip the pin of the fastener when in said closed position and to release the pin of the fastener when in said opened position, said installation means further including anvil means adapted to engage the collar and/or sleeve of the fastener, said installation means being operatively connected to said pull piston for transmitting said pull relative axial force of said piston between said jaw means and said anvil for applying said predetermined relative axial force between the pin and collar and/or sleeve when said jaw means has gripped the pin of the fastener and said anvil means is in engagement with the collar and/or sleeve of the fastener, said installation means including jaw actuating means operable for moving said jaw means to said opened and closed positions, said power means further including a power cylinder housing having a cylinder housing section and an integrally formed handle section depending from said cylinder housing section and adapted to be gripped by an operator, said cylinder housing section having an axially extending cylinder bore adapted to receive said piston head of said pull piston for reciprocating movement therein, and fluid passage means extending through said handle section, through the juncture integrally connecting said cylinder housing section and said handle section and radially through said cylinder housing section directly into said cylinder bore for fluid communicating said cylinder bore on opposite sides of said piston head whereby said pull piston can be selectively reciprocated within said power cylinder housing, a deflector adapted to be secured to the rearward end of said cylinder housing section, and including a deflection portion extending in line with and over said passageway to receive the impact of the severed pull portion, said deflector being constructed of an elastomeric material and having a wear plate at said deflector portion to receive the impact of the severed pull portion, said wear plate being constructed of a hardened, wear resistant material, said pull piston including a piston rod portion having a threaded outer end, said collet having an enlarged bore at its rearward end adapted to be threadably engaged with said threaded outer end of said piston rod portion whereby said collet assembly will be axially reciprocated by said pull piston, said threaded outer end of said piston rod portion having a plurality of axially extending slots, said collet having a radially extending locking bore extending through said enlarged bore with a locking ball assembly located therein, said locking ball assembly including a ball member radially movable into a selected one of said slots while remaining at least partially in said locking bore, said anvil housing being located over said collet to capture said ball member in said locking bore and said slot whereby said collet and said piston rod portion are locked together from relative rotation, mounting means removably securing said anvil housing to said cylinder housing.

13. The installation tool of claim 12 with said mounting means securing said anvil housing to said cylinder housing while permitting selective relative rotation therebetween.

14. The installation tool of claim 12 further comprising a manually actuable electrical switch located in an enlarged switch bore in the forward side of said handle section proximate to the juncture of said handle section with said cylinder housing section, said handle section extending downwardly from the juncture of said handle section with said cylinder housing section for a distance of no less than around four inches, said fluid passage means comprising a pair of generally parallely extending forward and rear passageways extending upwardly longitudinally from the bottom of said handle section towards said cylinder housing section, a crossbore extending transversely to said pair of passageways from said switch bore and intersecting both of said pair of passageways near the juncture of said handle section with said cylinder housing section, a forward connecting passage extending substantially directly in line with the forward one of said passageways and into the forward portion of said cylinder bore, a rearward connecting passage extending angularly from the rearward end of said cylinder bore to said crossbore in communication with said rear passageway, seal means in said crossbore for sealing said pair of passageways from each other and for sealing said crossbore from said switch bore.

15. The installation tool of claim 14 with said rearward connecting passage located in a position relative to said rearward end of said cylinder bore whereby its axis extends angularly along a line outwardly through said rearward end of said cylinder bore and with a preselected clearance with the rearward end of said cylinder housing section.

* * * * *

UNITED STATES PATENT AND TRADEMARK OFFICE

CERTIFICATE OF CORRECTION

PATENT : 5,598,619

DATED : February 4, 1997

INVENTOR(S) : Hendrick E. Rosier

It is certified that error appears in the above-identified patent and that said Letters Patent is hereby corrected as shown below:

Delete columns 1-16, and substitute therefor the attached columns 1-18.

Signed and Sealed this

Twenty-fifth Day of November, 1997

*Attest:*

Bruce Lehman

BRUCE LEHMAN

*Attesting Officer*

*Commissioner of Patents and Trademarks*

HYDRAULIC INSTALLATION TOOL

SUMMARY BACKGROUND OF THE INVENTION

The present invention relates to installation tools for setting pull type fasteners. A general example of such an installation tool is shown in U.S. Pat. No. 3,329,000 issued Jul. 4, 1967 to Schwab et al for Swaging Tool. See also the U.S. Pat. No. 4,964,292 issued Oct. 23, 1990 to Kaelin et al for "Shock Absorbing Fluid Actuated Pressure System". Such tools include nose assemblies, examples of which are shown in U.S. Pat. No. 3,107,806 issued Oct. 22, 1963 to Van Hecke et al for "Modified Nose Assembly", and U.S. Pat. No. 4,347,728, issued Sep. 7, 1982 to Smith for "Apparatus And System For Setting Fasteners".

As can be seen, these installation tools and related nose assemblies are utilized in conjunction with a hydraulic and/or pneumatic power source for installing multi-pieced fasteners by applying a relative axial pulling force, for example, between a pin or mandrel and a collar or sleeve. Examples of lockbolts or swage type fasteners employing a pin and collar and adapted to be set with a relative axial pulling force are shown in the '728 Smith patent, supra, U.S. Pat. No. 4,324,518, issued Apr. 13, 1992 to Dixon for "Dish Compensating Flush Head Fastener", and U.S. Pat. No. 5,090,852, issued Feb. 25, 1992 to Dixon for "High Strength Fastener And Method". Examples of blind type fasteners employing a pin and a sleeve and adapted to be set by a relative axial pulling force are shown in U.S. Pat. No. 4,627,775 issued Dec. 9, 1986 to Dixon for "Blind Fastener With Grip Compensating Means", U.S. Pat. No. 4,844,673, issued Jul. 4, 1989 to Kendall for "Lock Spindle Blind Bolt With Lock Collar Providing Pin Stop Support" and U.S. Pat. No. 4,863,325, issued Sep. 5, 1989 to Smith for "Two Piece Blind Fastener With Lock Spindle Construction". With both the lockbolt and blind type fasteners, the pin has an elongated shank provided with a pintail or pull portion having a plurality of pull grooves adapted to be gripped by a plurality of chuck jaws in the nose assembly. In the deactuated condition, the chuck jaws will be normally held open to facilitate insertion of the pintail portion into the aperture defined by the opened chuck jaws as well as ejection after the fastener has been set. During actuation with the pintail portion located in the nose assembly, the chuck jaws will be moved to a closed condition for engagement with the pull grooves whereby the pull grooves will be gripped by the chuck jaws.

An anvil member is adapted to engage the collar or sleeve, depending upon the type of fastener, and, upon actuation of the tool and with the chuck jaws gripping the pintail portion of the pin shank, as noted, a relative axial pulling force is then applied between the collar or sleeve and pin of the fastener by way of the relative axial force between the chuck jaws and the anvil. Typically the pin or mandrel is provided with a weakened portion or breakneck groove which is located on the pin shank between the pull or pintail portion and the remainder of the shank and is adapted to fracture at a preselected axial load, i.e. pin break load, after the fastener has been set. This results in an installed fastener having a generally flush and/or compact structure with minimal or no pintail protrusion. In certain tools the severed pintail portion is ejected rearwardly out through the back end of the tool; see for example the patents to Schwab et al, and to Kaelin et al, supra.

The magnitude of the pin break load required to fracture the breakneck groove, however, can result in the generation of a reaction load of significant magnitude. The magnitude of pin break load can be especially high with swage type fasteners since the breakneck groove must be of sufficient strength to withstand the high installation loads required for the anvil to swage the collar onto the pin. As a result, in hand held installation tools employing a construction for pass through or rearward ejection, the severed pintail portion could be ejected with a considerable force in the direction of the operator. As a result it has been a common practice with such tools to utilize a pintail deflector made of an elastomeric material to absorb some of the force of the pintail portion and to deflect the pintail portion away from the operator; see Schwab et al and Kaelin et al patents, supra.

In the present invention, a unique pintail deflector construction is provided which provides the deflecting function while enhancing the life of the deflector; in addition the construction permits selection by the operator of the direction of final ejection.

As noted such installation tools include a nose assembly which is separately, removably secured to a power cylinder. The nose assembly includes an anvil member and a collet assembly slidably supported therein. The collet assembly, which includes the chuck jaws, is adapted to be secured to the rod portion of a power piston. In the present invention a unique, simplified attachment construction is provided for removably securing the collet assembly to the piston rod portion.

In addition, for hand held tools, a handle assembly is provided which frequently is a separate assembly adapted to be removably secured to a piston housing. In such structures the handle assembly includes a handle having fluid passageways for carrying hydraulic fluid from a hydraulic pressure source to and from the cylinder housing for actuation of the power piston. While the use of a separate handle facilitates the formation of the passageways during manufacture, it also requires extra assembly steps and the provision of specially constructed hydraulic seals to seal between the passageways in the handle and those operatively related passageways in the cylinder housing. In the present invention a simplified construction is provided whereby the handle and cylinder housing can be a unitary construction and the need for such extra assembly steps and specially constructed hydraulic seals is obviated.

Thus it is an object of the present invention to provide a unique construction for an installation tool including an improved pintail deflector, nose assembly attachment and overall housing construction.

Other objects, features, and advantages of the present invention will become apparent from the subsequent description and the appended claims, taken in conjunction with the accompanying drawings.

BRIEF DESCRIPTION OF THE DRAWINGS

Figure 1:
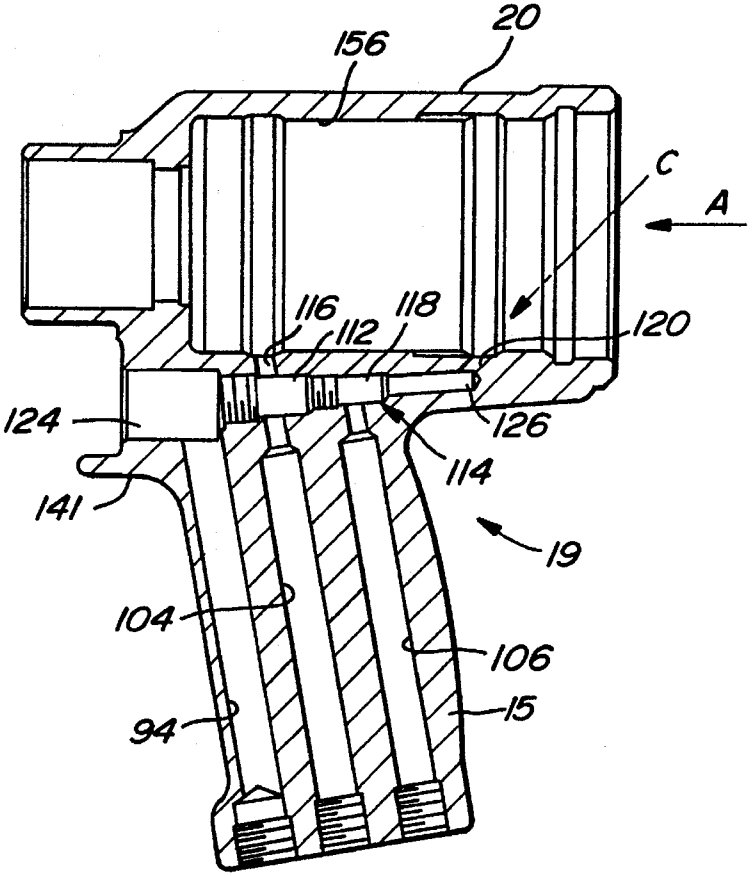
FIG. 1 is a side elevation sectional view of a unitary housing cylinder and handle construction of an installation tool prior to assembly of the remaining components of the installation tool and illustrating features of the present invention.
Figure 4:
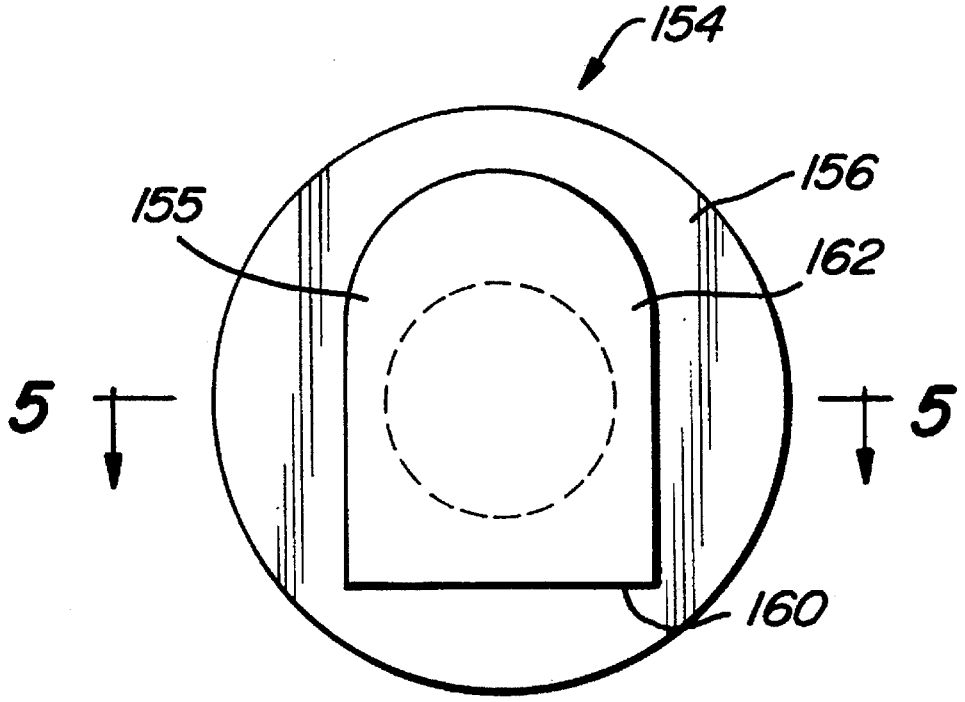
FIG. 4 is an end view of the pintail deflector taken generally in the direction of the Arrow B in FIG. 3.

FIG. 1 is a side elevation sectional view of a unitary housing cylinder and handle construction of an installation tool prior to assembly of the remaining components of the installation tool and illustrating features of the present invention;

FIG. 2 is an end view, to enlarged scale, of the unitary cylinder housing and handle of FIG. 1 taken generally in the direction of the Arrow A;

FIG. 3 is a side elevational, sectional view of the fastener installation tool including the unitary cylinder housing and handle construction of FIGS. 1 and 2 with a nose assembly and pintail deflector in assembled relationship and illustrating features of the present invention and with the installation tool shown in the deactuated condition; a control unit and hydraulic pressure source which are operable with the installation tool are generally shown in block form;

FIG. 4 is an end view of the pintail deflector taken generally in the direction of the Arrow B in FIG. 3; and FIG. 5 is a sectional view of the pintail deflector taken generally in the direction of the Arrows 5—5 in FIG. 4.

DETAILED DESCRIPTION OF A PREFERRED FORM OF THE INVENTION

Looking now to the drawings, an installation tool is generally indicated by the numeral 10 and includes a nose assembly 12 and a power unit assembly 14. As will be seen the power unit assembly 14 is operable from a source of hydraulic pressure and is adapted to apply a relative axial force through the nose assembly 12 for setting multi-pieced fasteners such as the lockbolt type and/or blind fasteners previously discussed. The power unit assembly 14 includes a power cylinder housing 19 which includes a cylinder housing section 20 with an integrally formed handle section 15 depending therefrom and adapted to be gripped by an operator.

The nose assembly 12 comprises a tubular generally cylindrically shaped anvil housing 16 having an axially extending bore 18 of a stepped construction. The anvil housing 16 is removably secured to the forward end of the cylinder housing section 20 by means of a retaining nut 22, in a manner to be described. The rearward end of the anvil housing 16, which is connected with the retaining nut 22, is open while the opposite or forward end is substantially closed by an anvil portion 24 having a centrally disposed bore or aperture 26 located therein. In the embodiment shown, the bore 26 is configured to define a swage cavity adapted to perform a swaging operation on the collar of a swage type fastener in a manner known in the art; e.g., see the patents previously identified re lockbolt or swage type fasteners and related nose assemblies. It should be noted that while the installation tool 10, as shown and described, is specifically configured for the installation of lockbolt or swage type fasteners, features of the present invention can be utilized for tools for installing blind fasteners and other non-swage type which are installed by the application of a relative axial pulling force.

As noted, the specific embodiment of the installation tool 10 shown in the drawings and described herein is for use in setting swage type fasteners or lockbolts generally of the type shown in the '852 and '518 patents to Dixon, supra. Details of such fasteners have been omitted for purposes of simplicity it being understood that references to pins, collars and portions thereof are of the type well known in the fastener art including those as illustrated in the noted patents.

A collet assembly 28 is located in the anvil housing member 16 and includes a generally tubular collet housing 30 which is slidably supported in bore 18 in the anvil housing member 16. The collet housing 30 has a tubular collar ejector portion 32 at its forward end. The collar ejector portion 32 extends axially and is movable partially within the bore or swage cavity 26 and is adapted to engage the collar of a fastener after it has been swaged by the installation tool 10 and to remove it from the swage cavity 26 at the conclusion of the installation cycle. The collet housing 30 is provided with a through bore 31 which is of a stepped construction and has a frusto-conically shaped seat or tapered bore portion 42 at its forward end for a purpose to be described.

The nose assembly 12 and power unit assembly 14 provide a construction by which the nose assembly 12 can be quickly assembled and disassembled from the power unit assembly 14. Thus the collet housing 30 is provided with an enlarged threaded bore portion 36 at the rearward end of the through bore 31 for threaded assembly onto the threaded, free, outer end 39 of a piston rod portion 38 of a pull piston 40. The free end 39 has a plurality of anti-rotation slots 43 axially extending through its thread form. In one embodiment of the present invention four equally, circumferentially spaced axial slots 43 were employed. A ball lock assembly 41, including a ball and annular sleeve, is located in a locking bore 53 extending radially through the threaded bore portion 36 with the ball adapted to be received within one of the slots 43 in the piston rod free end 39 to lock the collet housing 30 and hence the collet assembly 28 to the piston rod portion 38 from rotation. In assembling the nose assembly 12 to the power unit assembly 14, first the collet assembly 28 is secured to the pull piston 40 by threading the collet housing 30 onto the threaded free end 39 until it engages the shoulder 45 at the inner end of free end 39. Next the collet housing 30 is partially unthreaded until the locking bore 53 is in radial alignment with the first axial slot 43 which it meets. The ball of ball lock assembly 41 is then moved partially out of the locking bore 53 and into the aligned slot 43. Next the anvil housing member 16 is slipped over the collet assembly 28 and into a counterbore in piston rod bore portion 66 at the forward, outer end of the cylinder housing section 20. This now captures the ball, holding it from radial movement out from the engaged slot 43 and in this condition the collet housing 30 and pull piston 40 are locked together from relative rotation.

Next the retaining nut 22 is located over the anvil housing member 16 and is threaded onto the externally threaded outer end of the cylinder housing section 20. The anvil housing member 16 has an annular flange 80 adapted to be located in a stepped bore of the retaining nut 22 whereby the anvil housing member 16 and hence the nose assembly 12 can be removably secured to the outer end of the cylinder housing 20. As assembled the flange 80 is in a slight clearance with the confronting portion of the stepped bore of retaining nut 22 whereby the anvil housing 16 can be rotated after assembly. The forward end of the retaining nut 22 is provided with a plurality of flats 82 to permit gripping by a wrench. Thus when assembled as noted, the collet assembly 28 can be axially reciprocated by the pull piston 40 within the anvil housing member 16. At the same time the nose assembly 12 can be easily, quickly assembled onto the cylinder housing section 20. In addition, as noted, the above construction permits the anvil housing 16 to be freely rotated which could be particularly advantageous to provide selected alignment as with offset nose assemblies such as shown in U.S. Pat. No. 4,796,455 issued Jan. 16, 1989 to Rosier for Compact Offset Nose Assembly For Setting Fasteners and U.S. Pat. No. 4,813,261 issued Mar. 21, 1989 to Rosier for Rotatable Offset Nose Assembly for Setting Fasteners.

The collet assembly 28 includes a chuck jaw assembly 46 which can be of a unitized construction as generally shown and described in the '728 Smith patent, supra.

The unitized jaw assembly 46 comprises a plurality of jaw members 48 secured at their rearward ends to the leading surface of a generally tubular elastomeric sleeve member 50. The radially outer, forward surfaces 49 of the jaw members 48 together define a frusto conically inclined surface which is contoured for matable, sliding engagement with the similarly tapered bore portion 42.

The elastomeric member 50 can be of a flexible urethane construction. The jaw members 48 (which in one form are three in number) are bonded to the sleeve member 50. The rearward ends of the jaw members 48 can be notched, grooved or serrated to increase the surface area and to thereby enhance the bond with the sleeve member 50. The jaw members 48 are thus flexibly secured to the resilient sleeve member 50 and as secured can resiliently move radially. Note that since the sleeve member 50 is elastomeric the jaw members 48 can, to a degree, move resiliently axially forwardly and rearwardly. The jaw assembly 46 includes a support cap 51 which receives and secures the sleeve member 50 at its rearward end. The support cap 51 supports the sleeve member 50 and hence the rearward end of the jaw assembly 46 within the collet bore 18.

The jaw members 48 have teeth 52 for gripping similarly shaped pull grooves located on the pull portion of the pin shank of the shank of a pin member. With the jaw members 48 secured to the sleeve member 50 as described, the teeth 52 of each of the jaw members 48 are located and held in axial alignment with each other.

It is desirable that the jaw members 48 not be held closed under a high preload. To this end, the jaw members 48 can be located via the flexible connection with the sleeve member 50 such that in their relaxed, non actuated condition the jaw members 48 are generally opened, i.e. radially spaced from each other, whereby the crests of the jaw teeth 52 define an insertion diameter which is only slightly less than the crest diameter on the pull or pintail portion of the pin shank whereby a minimum insertion force is required to locate the pull portion of the pin shank within the opening defined by the chuck jaws 48. The initial gripping of the pull grooves of the pin shank will occur when the installation tool 10 is actuated to move the collet housing 30 rearwardly relatively to the anvil housing 16 with the tapered bore portion 42 in engagement with the frusto conical surface 49 of the jaw members 48.

The cylinder housing 20 has a generally uniform cylinder bore 56 which is adapted to receive an enlarged piston head 58 of the pull piston 40. The piston head 58 is adapted to be slidingly supported within the cylinder bore 56 with an annular seal 60 providing hydraulic sealing engagement between the piston head 58 and the confronting wall of the cylinder bore 56. A removable end cap 62 is located at the rearward end of the cylinder housing 20 and cooperates with an annular rear gland 63 to close that end of the cylinder bore 56 with an annular seal 64 providing a radially outer hydraulic seal therewith. The pull piston 40 has a rearwardly extending rod portion 65 which extends through and is slidably supported in aligned openings 67 and 69 of the end cap 62 and rear gland 63, respectively. A wiper seal 73 is supported in opening 69 and acts to keep dirt and contaminants out from a rear, radially inner seal 77.

The cylinder bore 56 is connected at its forward end to a reduced diameter piston rod bore portion 66. A front gland 68 has a front radially inner seal 70, an annular wiper 76 and an annular wiper seal 78 to provide a hydraulic seal with the front piston rod portion 38 while maintaining dirt and contamination out. At the same time, these seals and wipers are adapted to receive and slidably support the front piston rod portion 38. The gland 68 fits snugly within the front cylinder bore 56 and an annular, radially outer seal 72 provides a hydraulic seal therewith. In addition an annular seal 75 seals against a confronting face on the gland 68.

An axially extending valve rod 84 is located in the cylinder bore 56 and extends through the piston head 58 via a bore 86 and defines a relief valve construction generally of the type shown and described in the U.S. Pat. No. 3,362,211 issued Jan. 9, 1968 to Chirco for "Tool Construction". The valve rod 84 has its rearward end axially supported against the inner wall of the end cap 62. The valve rod 84, which is generally circular in cross section, is located snugly, with a generally close tolerance clearance, within the similarly shaped support bore 86. Valve rod 84 terminates at its rearward end adjacent the end cap 62 in a valve portion 88 defined by a plurality of axially extending flats. As noted in the '211 Chirco patent, supra, this provides a means for relieving the high level of hydraulic pressure built up when the pull piston 40 reaches the end of its pull stroke, with the piston head 58 having bottomed out adjacent the end cap 62 and hence with the circular bore 86 then being in line with the flats on the valve portion 88.

The handle section 15 has an electrical actuating switch 90 located and secured therein at its upper portion. Suitable electrical conductors 92 extend through an elongated bore 94 in handle section 15 and are connected to the switch 90 at one end and at the opposite end to a control unit 96 for controlling a hydraulic pressure source 98 to actuate pull piston 40. A pair of hydraulic lines 100 and 102 are connected at one of their ends to fluid passageways 104 and 106, respectively, in handle section 15 and, at their opposite ends, to ports 108 and 110, respectively, of the hydraulic pressure source 98.

The control unit 96 and hydraulic pressure source 98 can be of constructions known in the art, do not constitute a part of the present invention and hence the details thereof have been omitted for purposes of simplicity.

The hydraulic line 100 and passageway 104 are fluid communicated with the rod or pull side of cylinder bore 56 via an enlarged diameter portion 112 of a crossbore 114 and a passageway 116. The hydraulic line 102 and passageway 106 are fluid communicated with the piston head or return side of cylinder bore 56 via a reduced diameter portion 118 of the crossbore 114 and a passageway 120.

Thus hydraulic line 100 is in fluid communication with the rod end of cylinder bore 56 via passageway 106, crossbore portion 112 and passageway 116 while hydraulic line 102 is in fluid communication with the piston head end of cylinder bore 56 via passageway 106, crossbore portion 118 and passageway 120.

The power housing 19 is of a unique construction which facilitates assembly of related components and hydraulic sealing. As can be seen from FIGS. 1 and 2, the power housing 19, including the cylinder housing section 20 and handle section 15, is of a one piece construction which can be made from a casting with internal and external surfaces machined as required. Thus the passageways 104 and 116 can be coaxially machined from the bottom of the handle section 15 to communicate with the cylinder bore 56. The passageway 106 can be similarly machined from the bottom of the handle section 15. In the latter case, however, the passageway 106 is not directly connected to the cylinder bore 56. Thus the crossbore 114 is machined transversely through the handle section 15 and is of a stepped construction including the crossbore portions 112 and 118.

An enlarged bore or cavity 124 is first machined into the face of the handle section 15 to receive the switch 90. This cavity 124 is also conveniently used for the formation of and to permit access to the crossbore 114. The reduced diameter portion 118 is stepped and has a further reduced portion 126 which is extended to terminate near the back end of the cylinder bore 56. This reduced portion 126 is positioned to provide ready access through the rearward end of the cylinder bore 56 to permit machining of the passageway 120 in the direction of Arrow C. The adjoining section between enlarged diameter crossbore portion 112 and reduced diameter crossbore portion 118 is threaded whereby a conventional sealing plug 128 can be received. At the same time the adjoining section between the switch cavity 124 and enlarged diameter crossbore portion 112 is threaded whereby a conventional sealing plug 130 can be received. As can be seen, in this manner the cylinder housing section 20 and handle section 15 can be constructed as the one piece power housing 19. With the handle section 15 integral with the cylinder housing section 20 alignment and relative movement between the two sections is eliminated whereby only simple sealing plugs 128 and 130 are required. This is in contrast to constructions where separate handle and cylinder housing components are used.

With hand held installation tools such as the installation tool 10 it is conventional to provide an outwardly extending lip 141 which acts as a tool support with the handle section 15 extending downwardly therefrom at least around 4 inches to facilitate gripping by the operator.

The pull piston 40 has an axially extending through bore 140 which has a countersunk portion 142 at its forward end and an enlarged splined bore portion 144 at its rearward end. An elongated, cylindrical ejector tube 146 is snugly supported in the through bore 140 and has an enlarged, countersunk type head 148 which is seated in the countersunk bore portion 142 to preclude axial, rearward movement of the ejector tube 146. As can be seen the ejector tube 146 defines a passageway through the pull piston 40 to permit the severed pintail portions to pass rearwardly through the installation tool 10 for ejection from its rearward end. The ejector tube 146 can be made of a relatively hard, wear resistant material such that it will resist wear caused by the repeated ejection of the severed pintail portions. In one form of the invention the ejector tube 146 was constructed of ST 4130 Tubing. The splined bore portion 144 is adapted to receive a similarly shaped tool whereby rotation of the pull piston 40 can be prevented as the collet housing 30 is threaded on or off of the free end 39 of the piston rod portion 38. In this regard, in removal of the nose assembly 12, after the anvil housing member 16 is removed the ball of the ball lock assembly 41 will be simply detented radially outwardly from the associated slot 43 as the collet housing 30 is unthreaded from the threaded piston rod free end 39.

The end cap 62 has a rearwardly extending, reduced diameter retainer portion 150 which is provided with a series of annular retention serrations or barbs 152. An elongated pintail deflector 154 has a deflector body 155 which has an annular retaining portion 156 having a central opening 157 with a plurality of radially inner, annular grooves 159 adapted to engage the retention barbs 152 whereby the pintail deflector 154 can be removably assembled onto the back end of the cylinder housing section 20. The deflector body 155 of pintail deflector 154 is constructed of an elastomeric material such that it can be resiliently, radially expanded for assembly and disassembly relative to the retainer portion 150. In one form of the invention the deflector body 155 was constructed of polyurethane with a 72-78 Durometer.

The deflector body 155 has a shell like section 158 extending axially rearwardly from the annular retaining portion 156 with the section 158 having a generally U-shaped cross section with an elongated opening 160. (See FIG. 4). The rearward end portion 162 of the shell section 158 is in a blocking or deflecting position behind the central opening 157 and hence behind the rearward opening at the end of the installation tool 10 such that the severed pintail portions will engage the rearward end portion 162 as they are ejected. A thin gauge metal deflector or wear plate 164 is secured to the inner surface of the end portion 162 so as to provide a durable, wear resistant surface to receive the impact of the ejected pintail portions. The wear plate 164 can be molded or bonded to the end portion 162.

Looking now to FIG. 5, it can be seen that the wear plate 164 is of an arcuate shape to match the arcuate contour of the inner surface of the end portion 162 to which it is secured. In one form of the invention, the wear plate 164 was constructed from a section of a tube of a selected diameter to provide the desired arcuate shape. In this way a plurality of the wear plates 164 could be constructed from a single length of tubing. In one embodiment the wear plate 164 was constructed of ST 1018 tubing although it is believed that other tubings could be used such as ST 1015 ST 1020 Tubing. With this construction the wear plate can be of a minimal size reducing the cost and in one form was approximately 1 inch in vertical length and approximately 1 inch in circumferential length. Thus the wear plate 164 provides a wear resistant, durable impact surface while at the same time the elastomeric construction of the deflector body 155 absorbs shock loads and minimizes noise from impact of the severed pintail portions.

Note that the engagement of the annular retaining barbs 152 and the grooves 157 permit the pintail deflector 154 to be rotated to thereby locate the opening 160 and the direction of final pintail ejection in essentially any selected direction.

The hydraulic pressure source 98 has a high pressure section for moving the pull piston 40 rearwardly in its setting stroke to set the fastener and an intermediate pressure section for returning the pull piston 40 forwardly to its original position after the fastener has been installed and a low pressure tank or return section which receives the hydraulic fluid displaced from the cylinder bore 56 during the high pressure setting stroke or the intermediate pressure return stroke.

The installation tool 10 will be normally in its deactuated condition as shown in FIG. 3. With the actuating switch 90 in its deactuated condition, i.e. when not depressed by the operator, the control unit 96 will condition the hydraulic pressure source 98 to connect the port 108 to the return or tank section and the port 110 to the intermediate pressure section which is at a hydraulic pressure higher than that at the return or tank section. In this condition the rearward end of cylinder bore 56 will be pressurized relative to the front end or forward piston rod side of the cylinder bore 56 urging the pull piston 40 to its returned or deactuated position as shown in FIG. 3. To actuate the installation tool 10, the operator simply depresses the actuating switch 90 which signals the control unit 96 to condition the hydraulic pressure source 98 to connect the port 108, and hence hydraulic line 100, to the high pressure section and to connect the port 110 and hydraulic line 102 to the return or tank section. In this condition, the front end of the cylinder bore 56 will be connected to the high hydraulic pressure section while the rearward end of the cylinder bore 56 will be connected to return or tank section.

Thus in the deactuated condition of installation tool 10, as shown in FIG. 3, the chuck jaws 48 are radially separated and in their opened condition. In this condition, the shank of a pin of a swage type fastener can be inserted through the aperture or swage cavity 26 and into the opening defined by the radially separated chuck jaws 48. Upon actuation of the pull piston 40 rearwardly in its pull stroke, the collet housing 30 is moved rearwardly. As this occurs, the chuck jaws 48 by virtue of the light engagement of the jaw teeth 52 with the pull grooves of the pintail of the fastener are moved radially inwardly by the engagement with the frusto conical bore portion 42. The jaws 48 are moved to their radially closed position in which the jaw teeth 52 now fully grip the similarly shaped grooves on the pull portion of the pin shank of the fastener. With the jaw teeth 52 of jaws 48 gripping the pull grooves of the pin, the adjacent side surfaces of the jaws 48 will be slightly spaced from each other. In this position the chuck jaws 48 will define a generally circular aperture of around 360°. At this time the swage cavity 26 is engaged with the fastener collar which is located over the shank of the pin. Further movement of the collet housing 30 and the jaw assembly 46 relative to the swage cavity 26 will result in application of the desired relative axial force whereby the collar will be swaged onto lock grooves on the shank of the pin. Upon the application of additional relative axial force, the pin member will be severed at the breakneck groove. Upon fracture of the pin shank the resultant shock load will move the jaw assembly 46 axially rearwardly and at the same time will resiliently move the jaws 48 to their open condition whereby the severed portion of the pin shank will be released by the jaws 48. The severed portion of the pin member will then pass through the installation tool 10 via the ejector tube 146 for ejection out at the rearward end. In this regard the sleeve member 50 being resilient does permit deflection of the jaw members 48 and also provides a shock absorbing function at pin break.

Next the installation tool 10 is returned to its original, deactuated condition by the operator releasing the actuating switch 90. In this condition, the control unit 96 conditions the hydraulic pressure source 98 to connect the forward or piston rod end of the cylinder bore 56 to the tank or return section and the piston head end of the cylinder bore 56 to the intermediate pressure section. Now the pull piston 40 on its return stroke is moved axially forwardly to its original, axially forward position. As this occurs, the collar ejector member 32 engaged the swaged collar whereby the swaged collar is ejected from the swage cavity 26.

After pin break and with the pull piston 40 in its fully actuated rearward position at the end of the pull stroke, the high pressure being applied during the pull stroke could increase since the pull piston 40 is no longer moving. The potentially high pressure that could be built up in the forward or piston rod end of cylinder bore 56 is relieved by way of the clearance between the flats of the valve rod 84 and the circular bore 86. In this position the valve portion 88 is, in a sense, actuated to permit high pressure fluid to flow from the forward or rod end of the cylinder bore 56 to the rearward or piston head end and thereafter to the tank or return section of the hydraulic pressure source 98. This reduces the pressure at the forward or rod end of the cylinder bore 56, inhibiting damage to the seals and/or related structure.

Thus a hand held installation tool having a unique feature including unique power cylinder housing having an integral handle section and cylinder housing section and also including a unique pintail deflector construction.

While it will be apparent that the preferred embodiments of the invention disclosed are well calculated to fulfill the objects above stated, it will be appreciated that the invention is susceptible to modification, variation and change without departing from the proper scope or fair meaning of the invention.

What is claimed is:

1. A hand held installation tool for installing multipiece fasteners of the type including a pin and a collar and/or sleeve with the pin having a pull portion and with the fastener adapted to be installed by the application of a predetermined relative axial force between the pin and the collar and/or sleeve, the improvement comprising:

power means including a pull piston having an enlarged piston head adapted for reciprocating axial movement and for providing a relative axial force during such axial movement, installation means including jaw means having opened and closed positions and adapted to grip the pin of the fastener when in said closed position and to release the pin of the fastener when in said opened position, said installation means further including anvil means adapted to engage the collar and/or sleeve of the fastener, said installation means being operatively connected to said piston of said power means for transmitting said relative axial force of said piston between said jaw means and said anvil means for applying said predetermined relative axial force between the pin and collar and/or sleeve when said jaw means has gripped the pin of the fastener and said anvil means is in engagement with the collar and/or sleeve of the fastener, said installation means including jaw actuating means operable for moving said jaw means to said opened and closed positions, said power means further including a power cylinder housing having a cylinder housing section and an integrally formed handle section joined thereto at a connecting juncture, said handle section depending from said connecting juncture to a bottom portion, said handle section adapted to be gripped by an operator, said cylinder housing section having an axially extending cylinder bore adapted to receive said piston head of said pull piston for reciprocating movement therein between a forward end and a rearward end of said cylinder bore, and fluid passage means extending through said handle section, through said connecting juncture, and radially through said cylinder housing section directly into said cylinder bore for fluid communicating said cylinder bore on opposite sides of said piston head whereby said pull piston can be selectively reciprocated within said power cylinder housing, said fluid passage means comprising a pair of generally parallely extending forward and rear passageways extending upwardly from said bottom portion of said handle section towards said cylinder housing section, a crossbore extending transversely to said pair of passageways and intersecting both of said pair of passageways near said connecting juncture of said handle section with said cylinder housing section, a forward connecting passage extending substantially directly in line with the forward one of said passageways and into said forward end of said cylinder bore, a rearward connecting passage extending angularly from said rearward end of said cylinder bore to said crossbore in communication with said rear passageway, seal means in said crossbore for sealing said pair of passageways from each other.

2. The installation tool of claim 1 with said rearward connecting passage located in a position relative to said rearward end of said cylinder bore whereby its axis extends angularly along an axis line outwardly through said rearward end of said cylinder bore and with said axis line having a preselected clearance with the end of said cylinder housing section which is proximate to said rearward end of said cylinder bore.

3. A hand held installation tool for installing multipiece fasteners of the type including a pin and a collar and/or sleeve with the pin having a pull portion and with the fastener adapted to be installed by the application of a predetermined relative axial force between the pin and the collar and/or sleeve, the improvement comprising:

power means including a pull piston having an enlarged piston head adapted for reciprocating axial movement and for providing a relative axial force during such axial movement, installation means including jaw means having opened and closed positions and adapted to grip the pin of the fastener when in said closed position and to release the pin of the fastener when in said opened position, said installation means further including anvil means adapted to engage the collar and/or sleeve of the fastener, said installation means being operatively connected to said piston of said power means for transmitting said relative axial force of said piston between said jaw means and said anvil means for applying said predetermined relative axial force between the pin and collar and/or sleeve when said jaw means has gripped the pin of the fastener and said anvil means is in engagement with the collar and/or sleeve of the fastener, said installation means including jaw actuating means operable for moving said jaw means to said opened and closed positions, said power means further including a power cylinder housing having a cylinder housing section and an integrally formed handle section joined thereto at a connecting juncture, said handle section depending from said connecting juncture to a bottom portion, said handle section adapted to be gripped by an operator, said cylinder housing section having an axially extending cylinder bore adapted to receive said piston head of said pull piston for reciprocating movement therein between a forward end and a rearward end of said cylinder bore, and fluid passage means extending through said handle section, through said connecting juncture, and radially through said cylinder housing section directly into said cylinder bore for fluid communicating said cylinder bore on opposite sides of said piston head whereby said pull piston can be selectively reciprocated within said power cylinder housing, said handle section extending downwardly from said connecting juncture for a distance of no less than around four inches, said fluid passage means comprising a pair of generally parallely extending forward and rear passageways extending upwardly from said bottom portion of said handle section towards said cylinder housing section, a manually actuable electrical switch located in an enlarged switch bore in one side of said handle section proximate to said connecting juncture, a crossbore extending transversely to said pair of passageways from said switch bore and intersecting both of said pair of passageways near said connecting juncture, a forward connecting passage extending substantially directly in line with the forward one of said passageways and into said forward end of said cylinder bore, a rearward connecting passage extending angularly from said rearward end of said cylinder bore to said crossbore in communication with said rear passageway, seal means in said crossbore for sealing said pair of passageways from each other and for sealing said crossbore from said switch bore.

4. The installation tool of claim 4 with said rearward connecting passage located in a position relative to said rearward end of said cylinder bore whereby its axis extends angularly along an axis line outwardly through said rearward end of said cylinder bore and with said axis line having a preselected clearance with the end of said cylinder housing section which is proximate to said rearward end of said cylinder bore.

5. In a hand held installation tool for installing multipiece fasteners of the type adapted to be installed by the application of a predetermined relative axial force and having an installation means for engaging the fasteners for applying the predetermined relative axial force to the fasteners and a power source operatively connected with the installation means for providing the power to the installation means for the application of the predetermined relative axial force, the power source comprising:

power means including a pull piston having an enlarged piston head adapted for reciprocating axial movement and for providing a relative axial force during such axial movement, said power means further including a power cylinder housing having a cylinder housing section and an integrally formed handle section joined thereto at a connecting juncture, said handle section depending from said connecting juncture to a bottom portion, said handle section adapted to be gripped by an operator, said cylinder housing section having an axially extending cylinder bore adapted to receive said piston head of said pull piston for reciprocating movement therein between a forward end and a rearward end of said cylinder bore, and fluid passage means extending through said handle section through said connecting juncture and radially through said cylinder housing section directly into said cylinder bore for fluid communicating said cylinder bore on opposite sides of said piston head whereby said pull piston can be selectively reciprocated within said power cylinder housing, said fluid passage means comprising a pair of generally parallely extending forward and rear passageways extending upwardly from said bottom portion of said handle section towards said cylinder housing section, a crossbore extending transversely to said pair of passageways and intersecting both of said pair of passageways near said connecting juncture, a forward connecting passage extending substantially directly in line with the forward one of said passageways and into said forward end of said cylinder bore, a rearward connecting passage extending angularly from said rearward end of said cylinder bore to said crossbore in communication with said rear passageway, seal means in said crossbore for sealing said pair of passageways from each other.

6. The installation tool of claim 5 with said rearward connecting passage located in a position relative to said rearward end of said cylinder bore whereby its axis extends angularly along an axis line outwardly through said rearward end of said cylinder bore and with said axis line having a preselected clearance with the end of said cylinder housing section which is proximate to said rearward end of said cylinder bore.

7. In a hand held installation tool for installing multipiece fasteners of the type adapted to be installed by the application of a predetermined relative axial force and having an installation means for engaging the fasteners for applying the predetermined relative axial force to the fasteners and a power source operatively connected with the installation means for providing the power to the installation means for the application of the predetermined relative axial force, the power source comprising:

power means including a pull piston having an enlarged piston head adapted for reciprocating axial movement and for providing a relative axial force during such axial movement, said power means further including a power cylinder housing having a cylinder housing section and an integrally formed handle section joined thereto at a connecting juncture, said handle section depending from said connecting juncture to a bottom portion, said handle section adapted to be gripped by an operator, said cylinder housing section having an axially extending cylinder bore adapted to receive said piston head of said pull piston for reciprocating movement therein between a forward end and a rearward end of said cylinder bore, and fluid passage means extending through said handle section through said connecting juncture and radially through said cylinder housing section directly into said cylinder bore for fluid communicating said cylinder bore on opposite sides of said piston head whereby said pull piston can be selectively reciprocated within said power cylinder housing, a manually actuable electrical switch located in an enlarged switch bore in one side of said handle section proximate to said connecting juncture, said fluid passage means comprising a pair of generally parallely extending forward and rear passageways extending upwardly longitudinally from said bottom portion of said handle section towards said cylinder housing section, a crossbore extending transversely to said pair of passageways from said switch bore and intersecting both of said pair of passageways near said connecting juncture, a forward connecting passage extending substantially directly in line with the forward one of said passageways and into said forward end of said cylinder bore, a rearward connecting passage extending angularly from said rearward end of said cylinder bore to said crossbore in communication with said rear passageway, seal means in said crossbore for sealing said pair of passageways from each other and for sealing said crossbore from said switch bore.

8. The installation tool of claim 9 with said rearward connecting passage located in a position relative to said rearward end of said cylinder bore whereby its axis extends angularly along an axis line outwardly through said rearward end of said cylinder bore and with a preselected clearance with the end of said cylinder housing section which is proximate to said rearward end of said cylinder bore.

9. In an installation tool for installing multipiece fasteners of the type including a pin and a collar and/or sleeve with the pin having a shank with a pull portion and with the fastener adapted to be installed by the application of a predetermined relative axial force between the pin and the collar and/or sleeve, and with the pin shank having a weakened section adapted to fracture at a preselected magnitude of relative axial force substantially at the completion of the setting action whereby the pull portion is removed and with the installation tool having an installation means for engaging the fastener for applying the predetermined relative axial force between the pin and the collar and/or sleeve, said installation tool including:

power means operatively connected with the installation means for providing the power to the installation means for the application of the predetermined relative axial force, said power means including a pull piston having an enlarged piston head adapted for reciprocating axial movement and for providing a relative axial force during such axial movement, said pull piston having a forward end portion and a rearward end portion, installation means including jaw means having opened and closed positions, said power means further including a power cylinder housing having a cylinder housing section and a handle section depending from said cylinder housing section, an ejection passage extending axially through said pull piston and adapted to receive the severed pull portion at said forward end portion of said pull piston for passage through said rearward end portion for ejection rearwardly out from said installation tool, the improvement comprising:

a deflector adapted to be secured to the end of said cylinder housing section adjacent to said rearward end portion of said pull piston, said deflector including a deflection portion extending in line with and over said ejection passage at said rearward end portion of said pull piston to receive the impact of the severed pull portion, said deflector being constructed of an elastomeric material and having a wear plate at said deflector portion to receive the impact of the severed pull portion, said wear plate being constructed of a hardened, wear resistant material, said deflector including securing means on said deflector and said cylinder housing for securing said deflector to said cylinder housing and permitting selective rotation of said deflector generally around the axis of said ejector passage, said deflector having a discharge opening extending generally between said deflector portion and said securing means for permitting ejection of the severed pull portion and whereby said deflector can be rotated to radially position said discharge opening to eject the severed pull portion in a direction selected by the operator, said deflector being of a one piece body of elastomeric material with said wear plate being a separate metal member secured to said deflection portion, said deflector portion having a generally arcuate shape with said wear plate being constructed from a portion of a tube having a generally similar arcuate shape.

10. An installation tool for installing multipiece fasteners of the type including a pin having a shank and a collar and/or sleeve with the pin having a shank with a pull portion and with the fastener adapted to be installed by the application of a predetermined relative axial force between the pin and the collar and/or sleeve, the improvement comprising:

a power cylinder assembly including a cylinder housing and a piston adapted for reciprocating axial movement in said cylinder housing and for providing a relative axial force during such axial movement, a nose assembly removably secured to said cylinder housing and having an anvil housing having an anvil portion with an opening at one end adapted to receive the shank of the pin, a collet assembly slidably supported in said anvil housing and connected to said piston for reciprocating axial movement therewith, said collet assembly having a collet housing and jaw means supported in said collet housing having opened and closed positions and adapted to grip the pull portion of the pin shank when in said closed position and to release the pull portion of the pin shank when in said opened position, said anvil portion adapted to engage the collar and/or sleeve of the fastener, said anvil housing and said collet assembly being operatively connected to said cylinder housing and to said piston for transmitting said relative axial force of said piston between said jaw means and said anvil portion of said anvil housing for applying said predetermined relative axial force between the pin and collar and/or sleeve when said jaw means has gripped the pull portion of the pin shank and said anvil portion is in engagement with the collar and/or sleeve of the fastener, said collet assembly including jaw actuating means operable for moving said jaw means to said opened and closed positions and including resilient spring means operative on said jaw means for providing a spring bias on said jaw means to move said jaw means to said closed position, said piston including a piston rod portion having a threaded outer end, said collet housing having an enlarged bore at its rearward end adapted to be threadably engaged with said threaded outer end of said piston rod portion whereby said collet assembly will be axially reciprocated by said piston, said threaded outer end of said piston rod portion having a plurality of axially extending slots, said collet housing having a radially extending locking bore extending through said enlarged bore with a locking ball assembly located therein, said locking ball assembly including a ball member radially movable into a selected one of said slots while remaining at least partially in said locking bore, said anvil housing being located over said collet housing to capture said ball member in said locking bore and said slot whereby said collet and said piston rod portion are locked together from relative rotation, mounting means removably securing said anvil housing to said cylinder housing.

11. The installation tool of claim 10 with said mounting means securing said anvil housing to said cylinder housing while permitting selective relative rotation therebetween.

12. A hand held installation tool for installing multipiece fasteners of the type including a pin and a collar and/or sleeve with the pin having a pull portion and with the fastener adapted to be installed by the application of a predetermined relative axial force between the pin and the collar and/or sleeve, the improvement comprising:

power means including a pull piston having an enlarged piston head adapted for reciprocating axial movement and for providing a relative axial force during such axial movement, installation means including jaw means having opened and closed positions and adapted to grip the pin of the fastener when in said closed position and to release the pin of the fastener when in said opened position, said installation means further including anvil means comprising an anvil housing with an anvil section adapted to engage the collar and/or sleeve of the fastener and a collet located in said anvil housing and supporting said jaw means for axial movement relative to said anvil means, said installation means being operatively connected to said pull piston for transmitting said relative axial force of said piston between said jaw means and said anvil means for applying said predetermined relative axial force between the pin and collar and/or sleeve when said jaw means has gripped the pin of the fastener and said anvil section is in engagement with the collar and/or sleeve of the fastener, said installation means including jaw actuating means supported in said collet and operable for moving said jaw means to said opened and closed positions, said power means further including a power cylinder housing having a cylinder housing section and an integrally formed handle section connected thereto at a connecting juncture, said handle section depending from said connecting juncture and adapted to be gripped by an operator, said cylinder housing section having an axially extending cylinder bore adapted to receive said piston head of said pull piston for reciprocating movement therein between a forward end and a rearward end of said cylinder bore, and fluid passage means extending through said handle section, through said connecting juncture and radially through said cylinder housing section directly into said cylinder bore for fluid communicating said cylinder bore on opposite sides of said piston head whereby said pull piston can be selectively reciprocated within said power cylinder housing, said pull piston including a piston rod portion having a threaded outer end, said collet having an enlarged bore at its rearward end adapted to be threadably engaged with said threaded outer end of said piston rod portion whereby said collet will be axially reciprocated by said pull piston, said threaded outer end of said piston rod portion having a plurality of axially extending slots, said collet having a radially extending locking bore extending through said enlarged bore with a locking ball assembly located therein, said locking ball assembly including a ball member radially movable into a selected one of said slots while remaining at least partially in said locking bore, said anvil housing being located over said collet to capture said ball member in said locking bore and said slot whereby said collet and said piston rod portion are locked together from relative rotation, mounting means removably securing said anvil housing to said cylinder housing.

13 The installation tool of claim 12 with said mounting means securing said anvil housing to said cylinder housing while permitting selective relative rotation therebetween.

14. The installation tool of claim 12 further comprising a manually actuable electrical switch located in an enlarged switch bore in one side of said handle section proximate to said connecting juncture, said handle section extending downwardly from said connecting juncture of said handle section with said cylinder housing section to a bottom portion for a distance of no less than around four inches, said fluid passage means comprising a pair of generally parallely extending forward and rear passageways extending upwardly longitudinally from said bottom portion of said handle section towards said cylinder housing section, a crossbore extending transversely to said pair of passageways from said switch bore and intersecting both of said pair of passageways near said connecting juncture, a forward connecting passage extending substantially directly in line with the forward one of said passageways and into said forward end of said cylinder bore, a rearward connecting passage extending angularly from said rearward end of said cylinder bore to said crossbore in communication with said rear passageway, seal means in said crossbore for sealing said pair of passageways from each other and for sealing said crossbore from said switch bore.

15. The installation tool of claim 14 with said rearward connecting passage located in a position relative to said rearward end of said cylinder bore whereby its axis extends angularly along an axis line outwardly through said rearward end of said cylinder bore and with said axis line having a preselected clearance with the end of said cylinder housing section which is proximate to said rearward end of said cylinder bore.

* * * * *